US006438961B2

(12) United States Patent
Tuthill et al.

(10) Patent No.: US 6,438,961 B2
(45) Date of Patent: Aug. 27, 2002

(54) SWOZZLE BASED BURNER TUBE PREMIXER INCLUDING INLET AIR CONDITIONER FOR LOW EMISSIONS COMBUSTION

(75) Inventors: Richard Sterling Tuthill, Bolton, CT (US); William Theodore Bechtel, II; Jeffrey Arthur Benoit, both of Scotia, NY (US); Stephen Hugh Black, Duanesburg, NY (US); Robert James Bland, Clifton Park, NY (US); Guy Wayne DeLeonardo, Scotia, NY (US); Stefan Martin Meyer, Troy, NY (US); Joseph Charles Taura, Clifton Park, NY (US); John Luigi Battaglioli, Glenville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/811,764

(22) Filed: Mar. 20, 2001

Related U.S. Application Data

(63) Continuation of application No. 09/021,081, filed on Feb. 10, 1998, now abandoned.

(51) Int. Cl.[7] ..... F23R 3/14; F02C 3/00

(52) U.S. Cl. ..... 60/776; 60/737; 60/742; 60/748

(58) Field of Search ..... 60/737, 738, 739, 60/741, 742, 748, 39.02, 776

(56) References Cited

U.S. PATENT DOCUMENTS

| | | | |
|---|---|---|---|
| 2,801,134 | A | 7/1957 | Neugebaur et al. |
| 3,088,279 | A | 5/1963 | Diedrich |

(List continued on next page.)

FOREIGN PATENT DOCUMENTS

| | | |
|---|---|---|
| DE | 818 072 | 10/1951 |
| DE | 1 215 443 | 4/1966 |
| GB | 1 444 673 | 8/1976 |
| WO | WO 98/11383 | 3/1998 |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

(List continued on next page.)

*Primary Examiner*—Ted Kim
(74) *Attorney, Agent, or Firm*—Nixon & Vanderhye P.C.

(57) ABSTRACT

A burner for use in a combustion system of a heavy-duty industrial gas turbine includes a fuel/air premixer having an air inlet, a fuel inlet, and an annular mixing passage. The fuel/air premixer mixes fuel and air into a uniform mixture for injection into a combustor reaction zone. The burner also includes an inlet flow conditioner disposed at the air inlet of the fuel/air premixer for controlling a radial and circumferential distribution of incoming air. The pattern of perforations in the inlet flow conditioner is designed such that a uniform air flow distribution is produced at the swirler inlet annulus in both the radial and circumference directions. The premixer includes a swozzle assembly having a series of preferably air foil shaped turning vanes that impart swirl to the airflow entering via the inlet flow conditioner. Each air foil contains internal fuel flow passages that introduce natural gas fuel into the air stream via fuel metering holes that pass through the walls of the air foil shaped turning vanes. By injecting fuel in this manner, an aerodynamically clean flow field is maintained throughout the premixer. By injecting fuel via two separate passages, the fuel/air mixture strength distribution can be controlled in the radial direction to obtain optimum radial concentration profiles for control of emissions, lean blow outs, and combustion driven dynamic pressure activity as machine and combustor load are varied.

8 Claims, 3 Drawing Sheets

U.S. PATENT DOCUMENTS

| | | | | |
|---|---|---|---|---|
| 3,682,390 | A | | 8/1972 | Cheshire et al. |
| 4,141,213 | A | | 2/1979 | Ross |
| 4,589,260 | A | | 5/1986 | Krockow |
| 5,156,002 | A | | 10/1992 | Mowill |
| 5,211,004 | A | | 5/1993 | Black |
| 5,235,814 | A | | 8/1993 | Leonard |
| 5,259,184 | A | | 11/1993 | Borkowicz et al. |
| 5,274,995 | A | | 1/1994 | Horner et al. |
| 5,285,631 | A | * | 2/1994 | Bechtel, II et al. ..... 60/737 |
| 5,351,477 | A | | 10/1994 | Joshi et al. |
| 5,361,586 | A | | 11/1994 | McWhirter et al. |
| 5,404,711 | A | | 4/1995 | Rajput |
| 5,450,725 | A | | 9/1995 | Takahara et al. |
| 5,451,160 | A | | 9/1995 | Becker |
| 5,481,866 | A | | 1/1996 | Mowill |
| 5,572,862 | A | | 11/1996 | Mowill |
| 5,628,182 | A | | 5/1997 | Mowill |
| 5,636,510 | A | | 6/1997 | Béer et al. |
| 5,657,632 | A | | 8/1997 | Foss |
| 5,794,449 | A | | 8/1998 | Razdan et al. |
| 5,816,049 | A | | 10/1998 | Joshi |

OTHER PUBLICATIONS

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

"39th GE Turbine State–of–the–Art Technology Seminar", Tab 7, "Advances Gas Turbine Materials and Coatings", P.W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

"39th GE Turbine State–of–the–Art Technology Seminar", Tab 9, "GE Gas Turbine Combustion Flexibility", M. A. Davi, Aug. 1996.

"39th GE Turbine State–of–the–Art Technology Seminar", Tab 10, "Gas Fuel Clean–Up System Design Considerations for GE Heavy–Duty Gas Turbines", C. Wilkes, Aug. 1996.

"39th GE Turbine State–of–the–Art Technology Seminar", Tab 11, "Integrated Control Systems for Advanced Combined Cycles", Chu et al., Aug. 1996.

"39th GE Turbine State–of–the–Art Technology Seminar", Tab 12, "Power Systems for the 21st Century "H" Gas Turbine Combined Cycles", Paul et al., Aug. 1996.

"39th GE Turbine State–of–the–Art Technology Seminar", Tab 13, "Clean Coal and Heavy Oil Technologies for Gas Turbines", D. M. Todd, Aug. 1996.

"39th GE Turbine State–of–the–Art Technology Seminar", Tab 14, "Gas Turbine Conversions, Modifications and Uprates Technology", Stuck et al., Aug. 1996.

"39th GE Turbine State–of–the–Art Technology Seminar", Tab 15, "Performance and Reliability Improvements for Heavy–Duty Gas Turbines, "J. R. Johnston, Aug. 1996.

"39th GE Turbine State–of–the–Art Technology Seminar", Tab 16, "Gas Turbine Repair Technology", Crimi et al, Aug. 1996.

"39th GE Turbine State–of–the–Art Technology Seminar", Tab 17, "Heavy Duty Turbine Operating & Maintenance Considerations", R.F. Hoeft, Aug. 1996.

"39th GE Turbine State–of–the–Art Technology Seminar", Tab 18, "Gas Turbine Performance Monitoring and Testing", Schmitt et al., Aug. 1996.

"39th GE Turbine State–of–the–Art Technology Seminar", Tab 19, "Monitoring Service Delivery System and Diagnostics", Madej et al., Aug. 1996.

"39th GE Turbine State–of–the–Art Technology Seminar", Tab 20, "Steam Turbines for Large Power Applications", Reinker et al., Aug. 1996.

"39th GE Turbine State–of–the–Art Technology Seminar", Tab 21, "Steam Turbines for Ultrasupercritical Power Plants", Retzlaff et al., Aug. 1996.

"39th GE Turbine State–of–the–Art Technology Seminar", Tab 22, "Steam Turbine Sustained Efficiency", P. Schofield, Aug. 1996.

"39th GE Turbine State–of–the–Art Technology Seminar", Tab 23, "Recent Advances in Steam Turbines for Industrial and Cogeneration Applications", Leger et al., Aug. 1996.

"39th GE Turbine State–of–the–Art Technology Seminar", Tab 24, "Mechanical Drive Steam Turbines", D. R. Leger, Aug. 1996.

"39th GE Turbine State–of–the–Art Technology Seminar", Tab 25, "Steam Turbines for STAG™ Combined–Cycle Power Systems", M. Boss, Aug. 1996.

"39th GE Turbine State–of–the–Art Technology Seminar", Tab 26, "Cogeneration Application Considerations", Fisk et al., Aug. 1996.

"39th GE Turbine State–of–the–Art Technology Seminar", Tab 27, "Performance and Economic Considerations of Repowering Steam Power Plants", Stoll et al., Aug. 1996.

"39th GE Turbine State–of–the–Art Technology Seminar", Tab 28, "High–Power–Density™ Steam Turbine Design Evolution", J. H. Moore, Aug. 1996.

"39th GE Turbine State–of–the–Art Technology Seminar", Tab 29, "Advances in Steam Path Technologies", Cofer, IV, et al., Aug. 1996.

"39th GE Turbine State–of–the–Art Technology Seminar", Tab 30, "Upgradable Opportunities for Steam Turbines", D. R. Dreier, Jr., Aug. 1996.

"39th GE Turbine State–of–the–Art Technology Seminar", Tab 31, "Uprate Options for Industrial Turbines", R. C. Beck, Aug. 1996.

"39th GE Turbine State–of–the–Art Technology Seminar", Tab 32, "Thermal Performance Evaluation and Assessment of Steam Turbine Units", P. Albert, Aug. 1996.

"39th GE Turbine State–of–the–Art Technology Seminar", Tab 33, "Advances in Welding Repair Technology" J. F. Nolan, Aug. 1996.

"39th GE Turbine State–of–the–Art Technology Seminar", Tab 34, "Operation and Maintenance Strategies to Enhance Plant Profitability", MacGillivray et al., Aug. 1996.

"39th GE Turbine State–of–the–Art Technology Seminar", Tab 35, "Generator Insitu Inspections", D. Stanton.

"39th GE Turbine State–of–the–Art Technology Seminar", Tab 36, "Generator Upgrade and Rewind", Haplern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commericialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 63–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.

"Proceedings of the Advanced Turbine Systems Annual Program Review Meeting", vol. I, "Advanced Combustion Turbines and Cycles: An EPRI Prespective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.
"Proceedings of the Advanced Turbine Systems Annual Program Review Meeting", vol. I, "Westinhouse Thermal Barrier Coatings", Goedjen et al., p. 194–199, Oct., 1995.
"Proceedings of the Advanced Turbine Systems Annual Program Review Meeting", vol. I, "High Performance Steam Development", Duffy et al., p. 200–220, Oct., 1995.
"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.
"Proceedings of the Advanced Turbine Systems Annual Program Review Meeting", vol. II, "Lean Premixed Flames for Low $No_x$ Combustors", Sojka et al., p. 249–275, Oct., 1995.
"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.
"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.
"Proceedings of the Advanced Turbine Systems Annual Program Review Meeting", vol. II, "Life Prediction of Advanced Materials for Gas Turbine Application", Zamrik et al., p. 310–327, Oct., 1995.
"Proceedings of the Advanced Turbine Systems Annual Program Review Meeting", vol. II, "Advanced Combustion Technologies for Gas Turbine Power Plants", Vandsburger et al., p. 328–352, Oct., 1995.
"Proceedings of the Advanced Turbine Systems Annual Program Review Meeting", vol. II, "Combustion Modeling in Advanced Gas Turbine Systems", Smoot et al., p. 353–370, Oct., 1995.
"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.
"Proceedings of the Advanced Turbine Systems Annual Program Review Meeting", vol. II, "Rotational Effects on Turbine Blade Cooling", Govatzidakia et al., p. 391–392, Oct., 1995.
"Proceedings of the Advanced Turbine Systems Annual Program Review Meeting", vol. II, "Manifold Methods for Methane Combustion", Yang et al., p. 393–409, Oct., 1995.
"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.
"Proceedings of the Advanced Turbine Systems Annual Program Review Meeting, Vol. II", The Role of Reactant Unmixedness, Strain Rate, and Length Scale on Premixed Combustor Performance, Samuelsen et al., p. 415–422, Oct., 1995.
"Proceedings of the Advanced Turbine Systems Annual Program Review Meeting", vol. II, "Experimental and Computational Studies on Film Cooling With Compound Angle Injection", Goldstein et al., p. 423–451, Oct., 1995.
"Proceedings of the Advanced Turbine Systems Annual Program Review Meeting", vol. II, "Compatibility of Gas Turbine Materials with Steam Cooling", Desai et al., p. 452–464, Oct., 1995.
"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.
"Proceedings of the Advanced Turbine Systems Annual Program Review Meeting", vol II, Effects of Geometry on Slot–Jet Film Cooling Performance, Hyams et al., p. 474–496 Oct., 1995.
"Proceedings of the Advanced Turbine Systems Annual Program Review Meeting", vol. II, "Steam as Turbine Blade Coolant: Experimental Data Generation", Wilmsen et al., p. 497–505, Oct., 1995.
"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.
"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.

"Proceedings of the Advanced Turbine Systems Annual Program Review Meeting", "Allison Advanced Simple Cycle Gas Turbine System", William D. Weisbrod, p. 73–94, Nov., 1996.

"Proceedings of the Advanced Turbine Systems Annual Program Review Meeting", "The AGTSR Industry–University Consortium", Lawrence P. Golan, p. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.

"Proceedings of the Advanced Turbine Systems Annual Program Review Meeting", "Methodologies for Active Mixing and Combustion Control", Uri Vandsburger, p. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 19967.

"Proceedings of the Advanced Turbine Systems Annual Program Review Meeting", "Manifold Methods for Methane Combustion", Stephen B. Pope, p. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.

"Proceedings of the Advanced Turbine Systems Annual Program Review Meeting", "Combustion Instability Studies Application to Land–Based Gas Turbine Combustors", Robert J. Santoro, p. 233–252.

"Proceedings of the Advanced Turbine Systems Annual Program Review Meeting", Active Control of Combustion Instabilities in Low $NO_x$ Turbines, Ben T. Zinn, p. 253–264, Nov., 1996.

"Proceedings of the Advanced Turbine Systems Annual Program Review Meeting", "Life Prediction of Advanced Materials for Gas Turbine Application", Sam Y. Zamrik, p. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.

"Proceedings of the Advanced Turbine Systems Annual Program Review Meeting", "Compatibility of Gas Turbine Materials with Steam Cooling", Vimal Desai, p. 291–314, Nov., 1996.

"Proceedings of the Advanced Turbine Systems Annual Program Review Meeting", "Bond Strength and Stress Measurements in Thermal Barrier Coatings", Maurice Gell, p. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.

"Proceedings of the Advanced Turbine Systems Annual Program Review Meeting", "Flow Characteristics of an Intercooler System for Power Generating Gas Turbines", Ajay K. Agrawal, p. 357–370, Nov., 1996.

"Proceedings of the Advanced Turbine Systems Annual Program Review Meeting", "Improved Modeling Techniques for Turbomachinery Flow Fields", B. Lakshiminarayana, p. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.

"Proceedings of the Advanced Turbine Systems Annual Program Review Meeting", "Advanced Turbine Cooling, Heat Transfer, and Aerodynamic Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phosphor Fluoresence Imaging System", Mingking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.
"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schoenwald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176–5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Docment #486029, Oct. 1–Dec. 31, 1995, Publication Date, May 1, 1997, Report Nos.: DOE/MC/31176–5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE–FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos.: DE–FC21–95MC31176–18.
"Utility Advanced Turbine Systems (ATS) Technology Readiness Testing—Phase 3", Annual Technical Progress Report, Reporting Period: Oct. 1, 1996–Sep. 30, 1997.

"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.

"Proceedings of the 1997 Advanced Turbine Systems", Annual Program Review Meeting, Oct. 28–29, 1997.

* cited by examiner

SWOZZLE BASED BURNER TUBE PREMIXER INCLUDING INLET AIR CONDITIONER FOR LOW EMISSIONS COMBUSTION

This is a continuation of application Ser. No. 09/021,081, filed Feb. 10, 1998, now abandoned the entire content of which is hereby incorporated by reference in this application.

This invention was made with Government support under Contract No. DE-FC21-95MC-31176 awarded by the Department of Energy. The Government has certain rights in this invention.

TECHNICAL FIELD

The present invention relates to heavy duty industrial gas turbines and, in particular, to a burner for an industrial gas turbine including a fuel/air premixer enabling high-efficiency operation without producing undesirable air polluting emissions.

BACKGROUND

Gas turbine manufacturers are currently involved in research and engineering programs to produce new gas turbines that will operate at high efficiency without producing undesirable air polluting emissions. The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. The rate of chemical reactions forming oxides of nitrogen (NOx) is an exponential function of temperature. If the temperature of the combustion chamber hot gas is controlled to a sufficiently low level, thermal NOx will not be produced.

One preferred method of controlling the temperature of the reaction zone of a heat engine combustor below the level at which thermal NOx is formed is to premix fuel and air to a lean mixture prior to combustion. The thermal mass of the excess air present in the reaction zone of a lean premixed combustor absorbs heat and reduces the temperature rise of the products of combustion to a level where thermal NOx is not formed.

There are several problems associated with dry low emissions combustors operating with lean premixing of fuel and air. That is, flammable mixtures of fuel and air exist within the premixing section of the combustor, which is external to the reaction zone of the combustor. There is a tendency for combustion to occur within the premixing section due to flashback, which occurs when flame propagates from the combustor reaction zone into the premixing section, or autoignition, which occurs when the dwell time and temperature for the fuel/air mixture in the premixing section are sufficient for combustion to be initiated without an igniter. The consequences of combustion in the premixing section are degradation of emissions performance and/or overheating and damage to the premixing section, which is typically not designed to withstand the heat of combustion. Therefore, a problem to be solved is to prevent flashback or autoignition resulting in combustion within the premixer.

In addition, the mixture of fuel and air exiting the premixer and entering the reaction zone of the combustor must be very uniform to achieve the desired emissions performance. If regions in the flow field exist where fuel/air mixture strength is significantly richer than average, the products of combustion in these regions will reach a higher temperature than average, and thermal NOx will be formed. This can result in failure to meet NOx emissions objectives depending upon the combination of temperature and residence time. If regions in the flow field exist where the fuel/air mixture strength is significantly leaner than average, then quenching may occur with failure to oxidize hydrocarbons and/or carbon monoxide to equilibrium levels. This can result in failure to meet carbon monoxide (CO) and/or unburned hydrocarbon (UHC) emissions objectives. Thus, another problem to be solved is to produce a fuel/air mixture strength distribution, exiting the premixer, which is sufficiently uniform to meet emissions performance objectives.

Still further, in order to meet the emissions performance objectives imposed upon the gas turbine in many applications, it is necessary to reduce the fuel/air mixture strength to a level that is close to the lean flammability limit for most hydrocarbon fuels. This results in a reduction in flame propagation speed as well as emissions. As a consequence, lean premixing combustors tend to be less stable than more conventional diffusion flame combustors, and high level combustion driven dynamic pressure activity often results. This high level dynamic pressure activity can have adverse consequences such as combustor and turbine hardware damage due to wear or fatigue, flashback or blow out. Thus, yet another problem to be solved is to control the combustion driven dynamic pressure activity to an acceptably low level.

Lean, premixing fuel injectors for emissions abatement are in common use throughout the industry, having been reduced to practice in heavy duty industrial gas turbines for more than two decades. A representative example of such a device is described in U.S. Pat. No. 5,259,184, dated Nov. 9, 1993, invented by Richard Borkowicz, David Foss, Daniel Popa, Warren Mick and Jeffery Lovett; and assigned to the General Electric Company. Such devices have achieved great progress in the area of gas turbine exhaust emissions abatement. Reduction of oxides of nitrogen, NOx, emissions by an order of magnitude or more relative to the diffusion flame burners of prior art have been achieved without the use of diluent injection such as steam or water.

These gains in emissions performance, however, have been made at the expense of incurring several problems. In particular, flashback and flame holding within the premixing section of the device result in degradation of emissions performance and/or hardware damage due to overheating. In addition, increased levels of combustion driven dynamic pressure activity results in a reduction in the useful life of combustion system parts and/or other parts of the gas turbine due to wear or high cycle fatigue failures. Still further, gas turbine operational complexity is increased and/or operating restrictions on the gas turbine are necessary in order to avoid conditions leading to high-level dynamic pressure activity, flashback, or blow out.

In addition to these problems, conventional lean premixed combustors have not achieved maximum emission reductions possible with perfectly uniform premixing of fuel and air.

An example of a method for reducing the amplitude of combustion driven dynamic pressure activity in lean premixed dry low emissions combustors can be found in U.S. Pat. No. 5,211,004 dated May 18, 1997, invented by Steven H. Black, and assigned to General Electric Company. The current invention builds upon the principles disclosed in this prior patent by controlling both fuel/air radial profile and fuel injection pressure drop to minimize or eliminate the amplification resulting from the weak limit oscillation cycle.

DISCLOSURE OF THE INVENTION

The current invention is an improvement relative to the prior art in that the unique features of the premixer cause it to achieve performance improvements relative to the prior art in all of the problem areas noted above.

It is an object of the invention to achieve gas turbine exhaust emissions performance that is superior to current technology lean premixed dry low emissions combustor performance at elevated firing temperatures of the most advanced heavy-duty industrial gas turbines. In particular, the emissions of oxides of nitrogen (NOx) are to be minimized without compromising carbon monoxide (CO) or unburned hydrocarbon (UHC) emissions performance. It is another object of the invention to improve upon the resistance to flashback and flame holding within the premixer relative to current technology lean premixed dry low emissions combustors for heavy-duty industrial gas turbine application. It is yet another object of the invention to reduce the level of combustion driven dynamic pressure activity and increase the margin to lean blow out over the entire operating range of the gas turbine relative to current technology lean premixed dry low emissions combustors for heavy duty industrial gas turbines.

These and other objects of the invention are realized through the use of an inlet flow conditioner (IFC) located upstream of the premixer inlet. The IFC improves the air flow velocity distribution through the premixer, which improves the uniformity of the fuel/air mixture exiting the premixer. The premixer is made less sensitive to air flow maldistribution in the flow field approaching the premixer, and the distribution of air flow among burners of a multi-nozzle combustor is made more even through the use of the inlet flow conditioner.

In addition, fuel is injected through the surfaces of air foil shaped turning vanes in the premixer swirler in lieu of the conventional fuel injection tubes, spokes or spray bars of prior art. Fuel injection through the surfaces of the turning vanes minimizes the disturbance of the flow field and does not generate regions where the flow of fuel/air mixture stagnates or recirculates within the premixer. These regions of flow stagnation and/or recirculation, which are characteristic of the more intrusive, less aerodynamic features of prior art fuel injectors, form locations where flame can anchor in the premixer. Elimination of these regions makes it more difficult for flame to propagate into the premixer and for combustion to be sustained within the premixer.

Moreover, radial fuel/air mixture strength distribution control is obtained with two or more independently controllable fuel supplies injected at different locations on the aerodynamic turning vane surfaces. By controlling the relative richness of the mixture from hub to tip shroud on the swirler, dynamic pressure activity level and lean blow out margin can be controlled as the overall combustor stoichiometry is varied to match turbine load.

The invention combines three aerodynamic design innovations to produce a fuel/air premixer for use in the combustion system of a heavy-duty industrial gas turbine, burning natural gas fuel, which provides exceptional performance in the areas of fuel/air mixture uniformity, flashback resistance, and control of combustion driven dynamic pressure activity. The three aerodynamic design innovations are: (1) Inlet air flow conditioning; (2) Fuel injection through the vanes of an air swirler ("swozzle" assembly); and (3) Radial fuel/air concentration distribution profile control.

An inlet flow conditioner (IFC) includes a perforated annular shell at the inlet to the fuel/air premixer swirler through which air flowing to the premixer must pass. The pattern of perforations in this shell is designed such that a uniform air flow distribution is produced at the swirler inlet annulus in both the radial and circumferential directions. The pressure drop of the inlet flow condition allows it to produce the desired swirler inlet air flow uniformity even when a non-uniform flow field exists in the plenum surrounding the burner inlet.

The swozzle assembly includes a series of preferably air foil shaped turning vanes that impart swirl to the air flow entering via the IFC. Each air foil contains internal fuel flow passages that introduce natural gas fuel into the air stream via fuel metering holes, which pass through the walls of the air foil shaped turning vane. By injecting fuel in this manner, an aerodynamically clean flow field is maintained throughout the premixer. The flow stagnation and/or separation and recirculation associated with more intrusive fuel injection methods, such as the conventional fuel tubes or spray bars of prior art, are avoided, and this improves the resistance of the premixer to flashback and flame holding.

The purpose of injecting fuel via two separate passages and two sets of injection holes is to provide control over the fuel/air mixture strength distribution in the radial direction. By varying fuel flow split between the passages, optimum radial concentration profiles can be obtained for control of emissions, lean blow out, and combustion driven dynamic pressure activity as machine and combustor load are varied.

Downstream of the swozzle is an annular mixing passage formed between the hub and the shroud. Fuel/air mixing is completed in this passage, and a very uniform mixture is injected into the combustor reaction zone where burning takes place. Emissions generation is minimized because the uniformly lean mixture does not yield local hot zones where NOx is produced. In the center of the premixer is a conventional diffusion flame fuel nozzle, which is used at low turbine load when the mixture from the premixer becomes too lean to burn.

BRIEF DESCRIPTION OF THE DRAWINGS

These and other aspects and advantages of the invention will become apparent from the following detailed description of the invention, with reference to the accompanying drawings, in which.

BEST MODE FOR CARRYING OUT THE INVENTION

Figure 1:
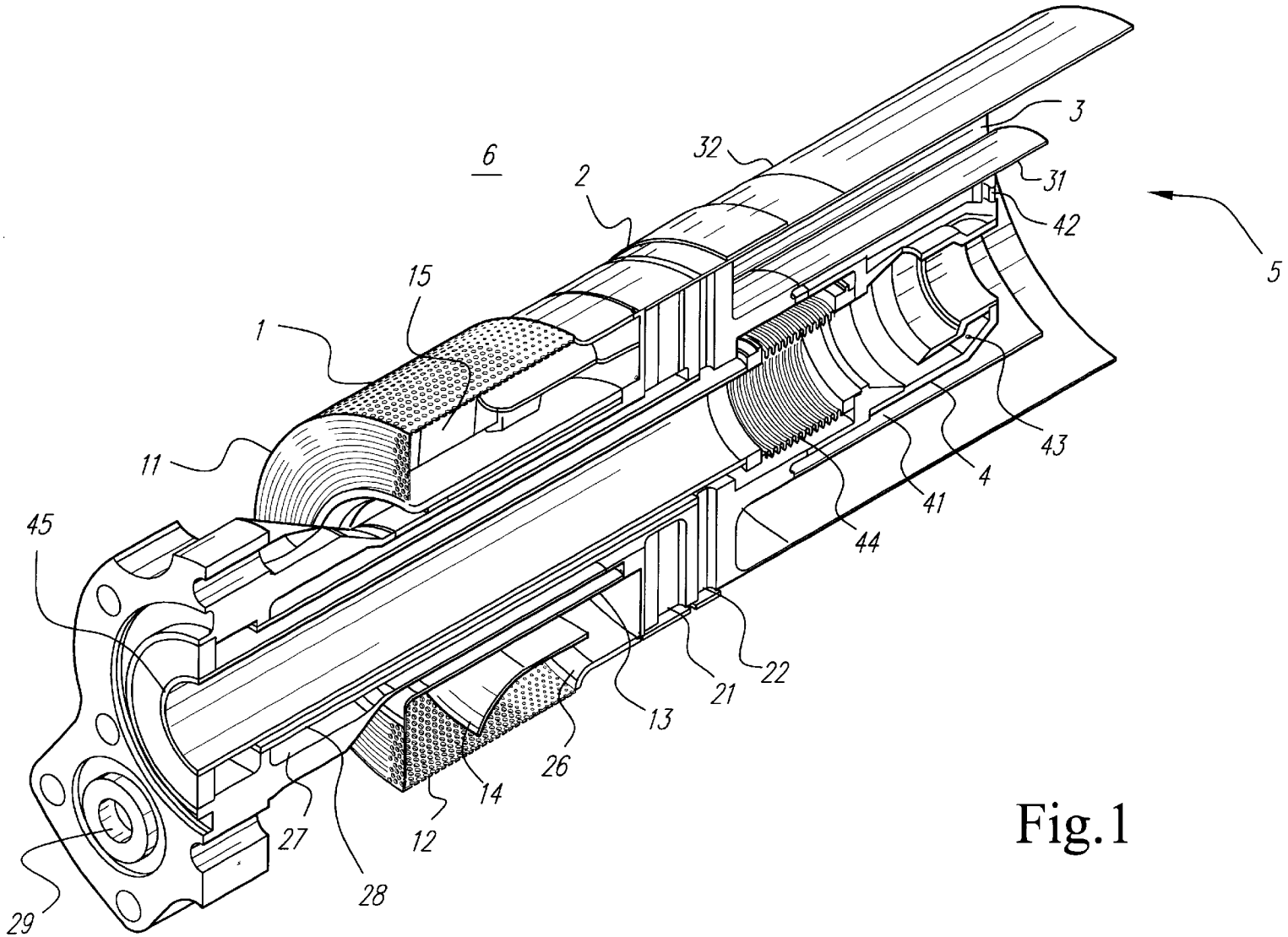
FIG. 1 is a cross-section view through the burner according to the present invention.
Figure 2:
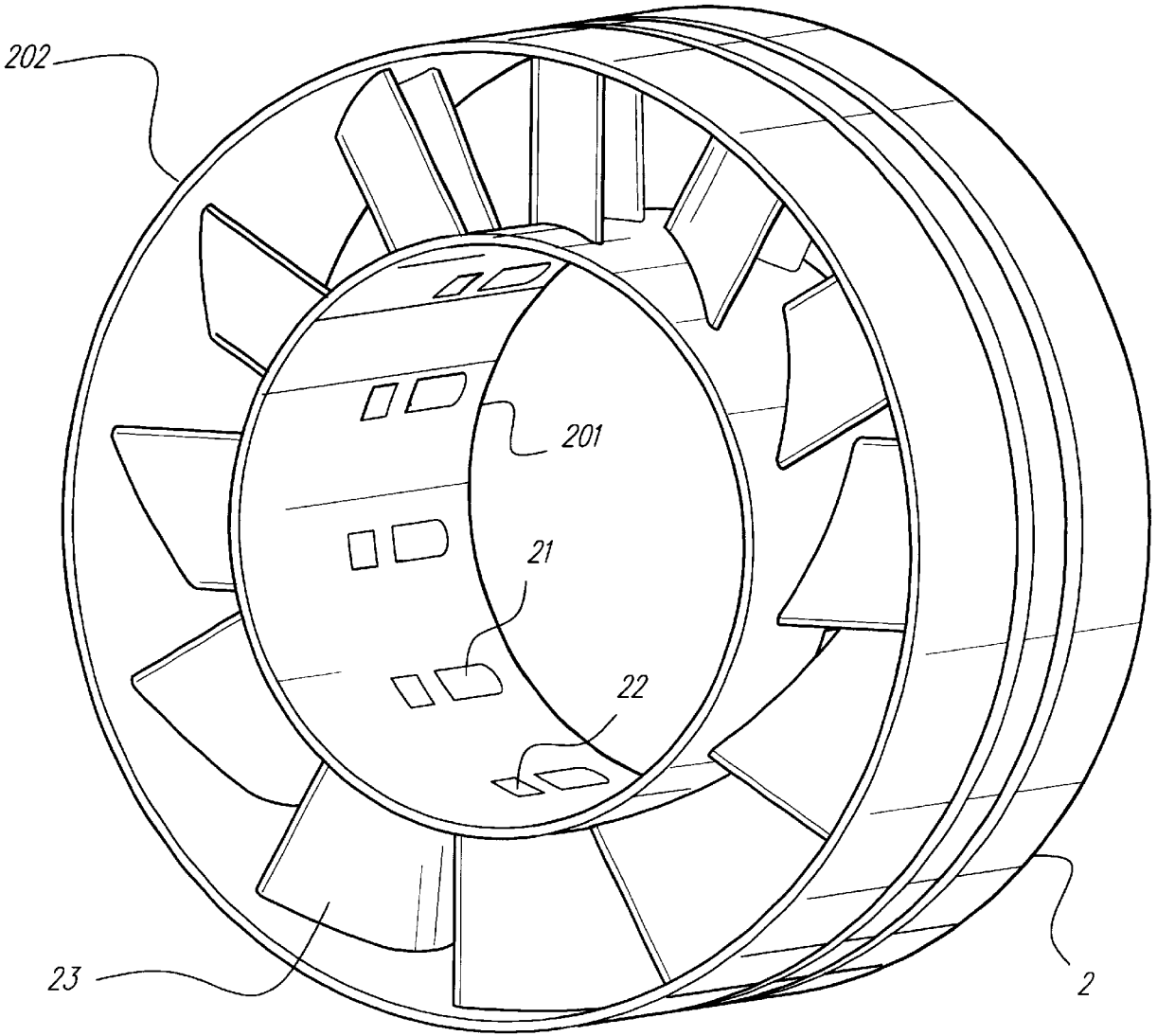
FIG. 2 illustrates the air swirler or swozzle assembly of the premixer according to the present invention.
Figure 3:
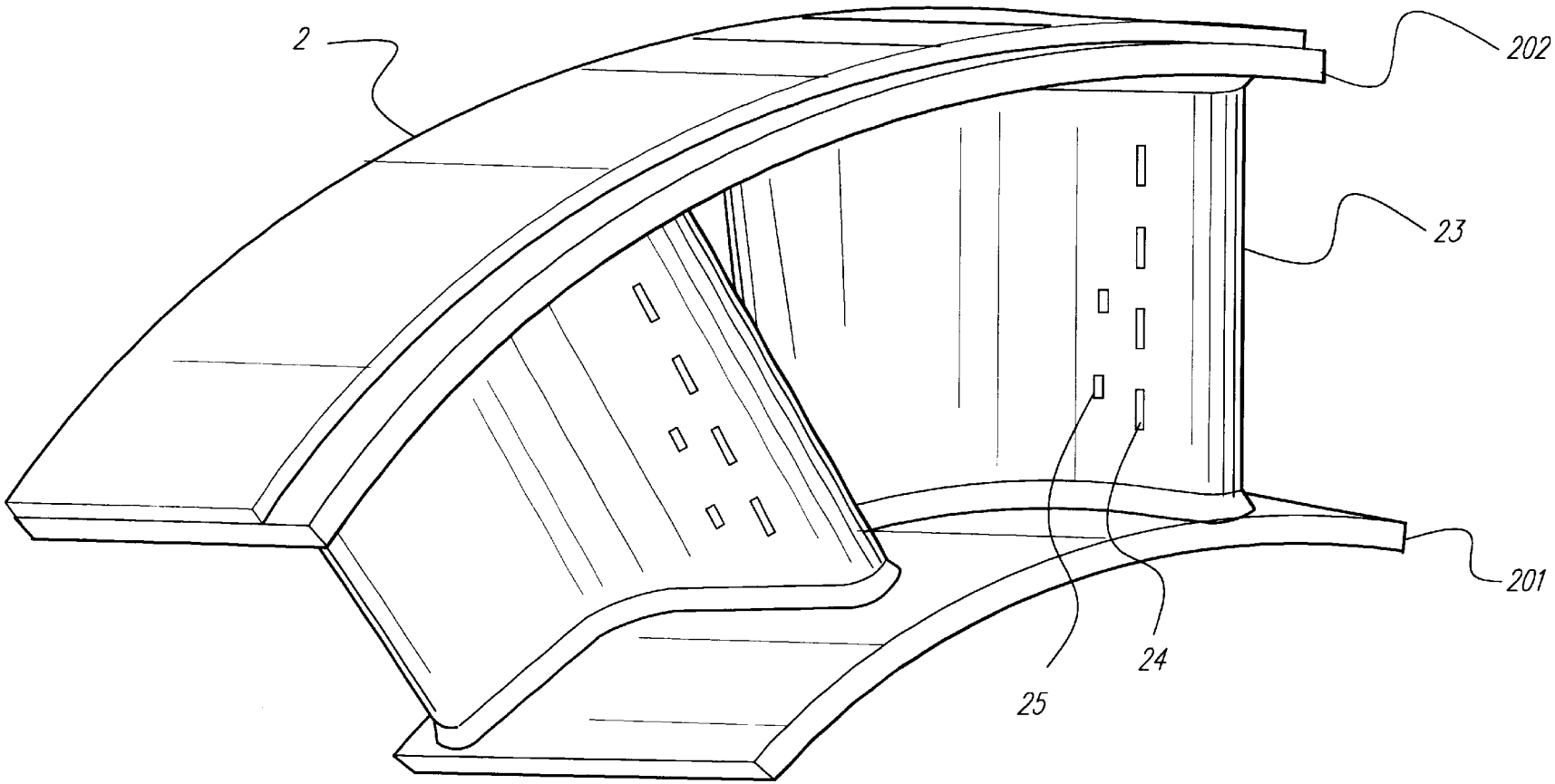
FIG. 3 is a close-up view of the turning vanes of the swozzle assembly illustrated in FIG. 2.

FIG. 1 is a cross-section through the burner according to the invention, and FIGS. 2 and 3 show details of the air swirler assembly with fuel injection through the turning vanes or swozzle. In practice, an air atomized liquid fuel nozzle would be installed in the center of the burner assembly to provide dual fuel capability; however, this liquid fuel nozzle assembly does not form part of the invention and has been omitted from the illustrations for clarity. The burner assembly is divided into four regions by function including an inlet flow conditioner 1, an air swirler assembly with natural gas fuel injection (referred to as a swozzle assembly) 2, an annular fuel air mixing passage 3, and a central diffusion flame natural gas fuel nozzle assembly 4.

Air enters the burner from a high pressure plenum 6, which surrounds the entire assembly except the discharge end, which enters the combustor reaction zone 5. Most of the air for combustion enters the premixer via the inlet flow conditioner (IFC) 1. The IFC includes an annular flow passage 15 that is bounded by a solid cylindrical inner wall 13 at the inside diameter, a perforated cylindrical outer wall 12 at the outside diameter, and a perforated end cap 11 at the upstream end. In the center of the flow passage 15 is one or more annular turning vanes 14. Premixer air enters the IFC 1 via the perforations in the end cap and cylindrical outer wall.

The function of the IFC 1 is to prepare the air flow velocity distribution for entry into the premixer. The principle of the IFC 1 is based on the concept of backpressuring the premix air before it enters the premixer. This allows for better angular distribution of premix air flow. The perforated walls 11, 12 perform the function of backpressuring the system and evenly distributing the flow circumferentially around the IFC annulus 15, whereas the turning vane(s) 14, work in conjunction with the perforated walls to produce proper radial distribution of incoming air in the IFC annulus 15. Depending on the desired flow distribution within the premixer as well as flow splits among individual premixers for a multiple burner combustor, appropriate hole patterns for the perforated walls are selected in conjunction with axial position of the turning vane(s) 14. A computer fluid dynamic code is used to calculate flow distribution to determine an appropriate hole pattern for the perforated walls. A suitable computer program for this purpose is entitled STAR CD by Adapco of Long Island, N.Y.

To eliminate low velocity regions near the shroud wall 202 at the inlet to the swozzle 2, a bell-mouth shaped transition 26 is used between the IFC and the swozzle.

Experience with multi-burner dry low emissions combustion systems in heavy-duty industrial gas turbine applications has shown that non-uniform air flow distribution exists in the plenum 6 surrounding the burners. This can lead to non-uniform air flow distribution among burners or substantial air flow maldistribution within the premixer annulus. The result of this air flow maldistribution is fuel/mixture strength maldistribution entering the reaction zone of the combustor, which in turn results in degradation of emissions performance. To the extent that the IFC 1 improves the uniformity of air flow distribution among burners and within the premixer annulus of individual burners, it also improves the emissions performance of the entire combustion system and the gas turbine.

After combustion air exits the IFC 1, it enters the swozzle assembly 2. The swozzle assembly includes a hub 201 and a shroud 202 connected by a series of air foil shaped turning vanes 23, which impart swirl to the combustion air passing through the premixer. Each turning vane 23 contains a primary natural gas fuel supply passage 21 and a secondary natural gas fuel supply passage 22 through the core of the air foil. These fuel passages distribute natural gas fuel to primary gas fuel injection holes 24 and secondary gas fuel injection holes 25, which penetrate the wall of the air foil. These fuel injection holes may be located on the pressure side, the suction side, or both sides of the turning vanes 23. Natural gas fuel enters the swozzle assembly 2 through inlet ports 29 and annular passages 27, 28, which feed the primary and secondary turning vane passages, respectively. The natural gas fuel begins mixing with combustion air in the swozzle assembly, and fuel/air mixing is completed in the annular passage 3, which is formed by a swozzle hub extension 31 and a swozzle shroud extension 32. After exiting the annular passage 3, the fuel/air mixture enters the combustor reaction zone 5 where combustion takes place.

Since the swozzle assembly 2 injects natural gas fuel through the surface of aerodynamic turning vanes (airfoils) 23, the disturbance to the air flow field is minimized. The use of this geometry does not create any regions of flow stagnation or separation/recirculation in the premixer after fuel injection into the air stream. Secondary flows are also minimized with this geometry with the result that control of fuel/air mixing and mixture distribution profile is facilitated. The flow field remains aerodynamically clean from the region of fuel injection to the premixer discharge into the combustor reaction zone 5. In the reaction zone, the swirl induced by the swozzle 2 causes a central vortex to form with flow recirculation. This stabilizes the flame front in the reaction zone 5. However, as long as the velocity in the premixer remains above the turbulent flame propagation speed, flame will not propagate into the premixer (flashback); and, with no flow separation or recirculation in the premixer, flame will not anchor in the premixer in the event of a transient causing flow reversal. The capability of the swozzle 2 to resist flashback and flame holding is extremely important for application since occurrence of these phenomena would cause the premixer to overheat with subsequent damage.

FIGS. 2 and 3 show details of the swozzle geometry. As noted, there are two groups of natural gas fuel injection holes on the surface of each turning vane 23, including the primary fuel injection holes 24 and the secondary fuel injection holes 25. Fuel is fed to these fuel injection holes 24, 25 through the primary gas passage 21 and the secondary gas passage 22. Fuel flow through these two injection paths is controlled independently, enabling control over the radial fuel/air concentration distribution profile from the swozzle hub 201 to the swozzle shroud 202.

Radial fuel concentration profile is known to play a significant role in determining the performance of lean premixed dry low emissions combustors, having a significant influence on the combustion driven dynamic pressure activity, the emissions performance and turndown capability. The radial profile control provides a means of compensating for natural gas fuel volume flow rate variation due to changes in fuel heating value (composition) and/or supply temperature. An additional advantage of this novel fueling scheme is the potential to load reject to the secondary fuel passages since the resulting hub-rich configuration could sustain combustion at a fraction of full load fuel flow.

At the center of the burner assembly is a conventional diffusion flame fuel nozzle 4 having a slotted gas tip 42, which receives combustion air from an annular passage 41 and natural gas fuel through gas holes 43. The body of this fuel nozzle includes a bellows 44 to compensate for differential thermal expansions between this nozzle and the premixer. This fuel nozzle is used during ignition, acceleration, and a low load where the premixer mixture is too lean to burn. This diffusion flame fuel nozzle can also provide a pilot flame for the premixer to extend this range of operability. In the center of this diffusion flame fuel nozzle is a cavity 45, which is designed to receive a liquid fuel nozzle assembly to provide dual fuel capability.

This invention provides direct active control of the fuel/air radial profile to allow optimal performance over a range of operating conditions. It also allows the possibility of a new load rejection strategy that can help reduce the number of fuel systems and thus the overall system cost.

In addition to providing control of the fuel/air radial profile, supplying fuel to the premixer by two independently controllable flow paths provides a means of controlling the pressure drop across the fuel injection holes. This provides another method of controlling dynamic pressure activity because the response of the fuel injection to pressure waves in the premixer can be adjusted to match the air supply response. This capability is retained even when variations in fuel supply heating value and/or temperature make it necessary to vary the volume flow of fuel through the injector because the total effective area of the fuel injection holes can be adjusted by varying the fuel flow split between the two flow paths. This capability is not available with injectors having a single fixed area fuel flow path, which is typical of prior art. By matching the premixer fuel and air response to pressure waves, the dynamic pressure amplification resulting from the weak limit oscillation cycle can be minimized or eliminated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A burner for use in a combustion system of a heavy duty industrial gas turbine, the burner comprising:

a fuel/air premixer having an air inlet, a fuel inlet, and an annular mixing passage, the fuel/air premixer mixing fuel and air in the annular mixing passage into a uniform mixture for injection into a combustor reaction zone, wherein the fuel/air premixer comprises a swozzle assembly downstream of the air inlet, the swozzle assembly including a plurality of swozzle assembly turning vanes imparting swirl to the incoming air, and wherein each of the swozzle assembly turning vanes comprises an internal fuel flow passage, the fuel inlet introducing fuel into the internal fuel flow passages; and an inlet flow conditioner disposed at the air inlet of the fuel/air premixer upstream of the fuel inlet, the inlet flow conditioner comprising an inner wall and at least one outer wall defining an annulus therebetween, the at least one outer wall comprising a plurality of perforations, wherein the inlet flow conditioner further comprises at least one annular turning vane, the plurality of perforations and the at least one turning vane controlling a radial and circumferential distribution of incoming air evenly distributing the incoming air about the annulus of the inlet flow conditioner.

2. A burner according to claim 1, wherein each of the turning vanes comprises two internal fuel flow passages receiving fuel from the fuel inlet, the fuel flow passages introducing fuel into the incoming air.

3. A burner according to claim 2, wherein the fuel flow passages introduce fuel into the incoming air via fuel metering holes corresponding to the fuel flow passages, the fuel metering holes passing through respective walls of the turning vanes.

4. A burner according to claim 1, wherein each of the turning vanes comprises a primary fuel passage and a secondary fuel passage feeding fuel to a corresponding primary fuel injection hole and secondary fuel injection hole, respectively.

5. A burner according to claim 1, wherein the plurality of perforations in the at least one outer wall of the inlet flow conditioner comprise a predetermined hole pattern based on a desired flow distribution.

6. A burner according to claim 5, wherein the inlet flow conditioner further comprises an annular flow passage bounded by the inner wall, the perforated outer wall, and a perforated end cap.

7. A method of premixing fuel and air in a burner for a combustion system of a heavy duty industrial gas turbine, the burner including a fuel/air premixer having an air inlet, a fuel inlet, and an annular mixing passage and an inlet flow conditioner disposed at the air inlet of the fuel/air premixer, wherein the fuel/air premixer includes a swozzle assembly downstream of the air inlet including a plurality of swozzle assembly turning vanes, and wherein each of the swozzle assembly turning vanes includes a primary fuel passage and a secondary fuel passage feeding fuel to a corresponding primary fuel injection hole and secondary fuel injection hole, respectively, the inlet flow conditioner comprising an inner wall and at least one outer wall defining an annulus therebetween, the at least one outer wall comprising a plurality of perforations, wherein the inlet flow conditioner further comprises at least one annular turning vane, the method comprising:

(a) controlling a radial and circumferential distribution of incoming air with the inlet flow conditioner upstream of the fuel inlet and evenly distributing the incoming air about an annulus of the inlet flow conditioner;

(b) imparting swirl to the incoming air; and (c) mixing fuel and air into a uniform mixture in the annular mixing passage for injection into a combustor reaction zone by independently controlling fuel flow through the primary fuel passage and the secondary fuel passage.

8. A method according to claim 7, wherein step (c) is further practiced by controlling a radial fuel/air concentration distribution profile from a swozzle assembly hub to a swozzle assembly shroud.

* * * * *